US008258899B2

(12) United States Patent
Feng et al.

(10) Patent No.: US 8,258,899 B2
(45) Date of Patent: Sep. 4, 2012

(54) NANO-ELECTRO-MECHANICAL SYSTEMS SWITCHES

(75) Inventors: Xiao-Li Feng, Pasadena, CA (US); Rassul B. Karabalin, Pomona, CA (US); John Sequoyah Aldridge, Pasadena, CA (US); Michael L. Roukes, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

(21) Appl. No.: 11/985,338

(22) Filed: Nov. 14, 2007

(65) Prior Publication Data

US 2011/0094861 A1 Apr. 28, 2011

Related U.S. Application Data

(60) Provisional application No. 60/858,819, filed on Nov. 14, 2006.

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 5,578,976 | A * | 11/1996 | Yao | 333/262 |
| 6,384,353 | B1 * | 5/2002 | Huang et al. | 200/181 |
| 6,731,492 | B2 * | 5/2004 | Goodwin-Johansson | 361/233 |
| 7,193,492 | B2 * | 3/2007 | Greywall et al. | 335/78 |
| 7,230,513 | B2 * | 6/2007 | Chou | 333/262 |
| 7,638,790 | B2 * | 12/2009 | Shim et al. | 257/9 |
| 8,044,442 | B2 * | 10/2011 | Kam et al. | 257/254 |
| 2003/0058069 | A1 * | 3/2003 | Schwartz et al. | 335/78 |
| 2005/0176228 | A1 * | 8/2005 | Fonash et al. | 438/597 |
| 2008/0088899 | A1 * | 4/2008 | Kamins et al. | 359/196 |
| 2009/0020399 | A1 * | 1/2009 | Kim et al. | 200/181 |

* cited by examiner

*Primary Examiner* — Bernard Rojas
(74) *Attorney, Agent, or Firm* — Gates & Cooper LLP

(57) ABSTRACT

NEMS (Nano-Electro-Mechanical Systems) apparatuses are described. By applying a static electric field, an arm or beam in a NEMS apparatus is made to bend so that one electrical conductor is made to contact another electrical conductor, thereby closing the NEMS apparatus. Some apparatus embodiments make use of electrostatic coupling to cause the arm or beam to bend, and some apparatus embodiments make use of piezoelectric materials to cause the arm or beam to bend. Other embodiments are described and claimed.

31 Claims, 7 Drawing Sheets

NANO-ELECTRO-MECHANICAL SYSTEMS SWITCHES

PRIORITY CLAIM

This application claims the benefit of U.S. Provisional Application No. 60/858,819, filed 14 Nov. 2006.

FIELD

Embodiments of the present invention relate to Nano-Electro-Mechanical-Systems.

DESCRIPTION OF EMBODIMENTS

In the description that follows, the scope of the term "some embodiments" is not to be so limited as to mean more than one embodiment, but rather, the scope may include one embodiment, more than one embodiment, or perhaps all embodiments.

Figure 1:
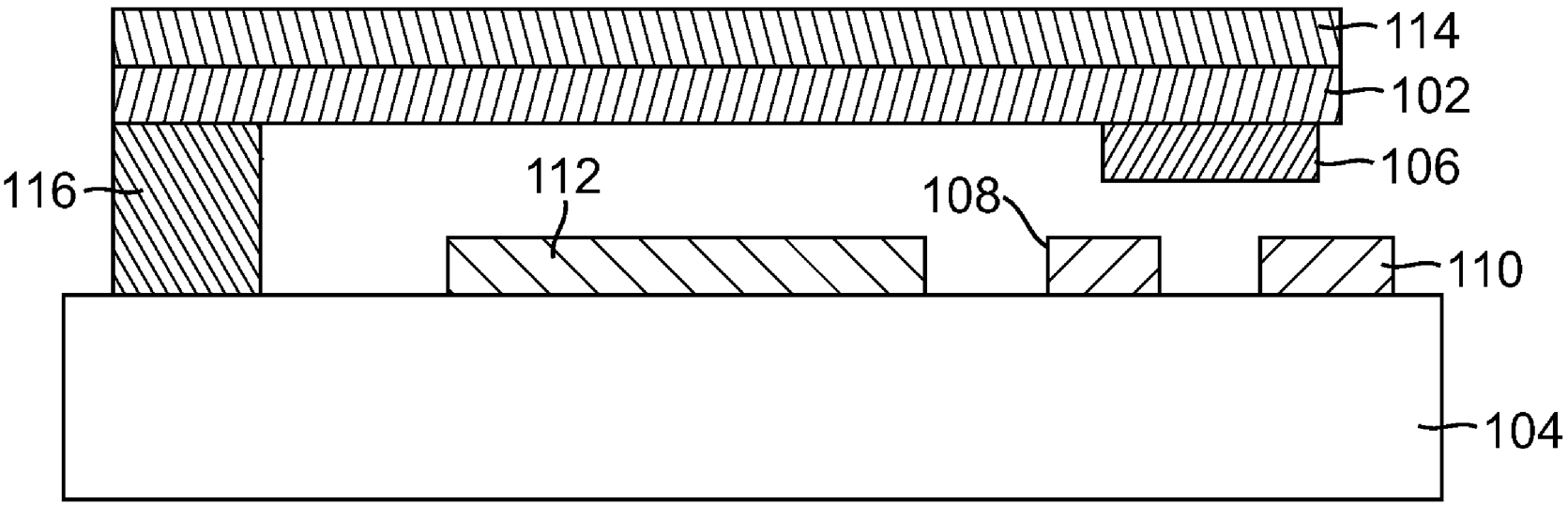
FIGS. 1, 2, and 3 illustrate NEMS electrostatically actuated switches according to some embodiments.

FIG. 1 is a simplified side-view illustration of a NEMS (Nano-Electro-Mechanical-Systems) switch based on electrostatic actuation according to an embodiment. To close the switch illustrated in FIG. 1, arm 102 is made to bend towards substrate 104 so that contact 106 comes into contact with both contacts 108 and 110. When closed, an electrical connection (very low impedance path) is made between contacts 108 and 110. The switch is open when contact 106 is not making contact with both contacts 108 and 110.

Arm 102 may bend toward substrate 104 due to a voltage difference between actuation electrodes 112 and 114. Actuation electrode 112 is formed on substrate 104, and actuation electrode 114 is formed on NEMS switch arm 102. Arm 102 is coupled to substrate 104 by way of support 116. The electrostatic (capacitive) coupling between actuation electrodes 112 and 114 provides the actuation force. When the actuation force is removed, arm 102 springs back to an open position where contact 106 is not in contact with contacts 108 and 110.

For some embodiments, contacts 106, 108, 110, and actuation electrodes 112 and 114 are metallic layers, such as for example copper, gold, platinum, and tungsten, to name a few. Some embodiments may utilize other conductive materials. For some embodiments, substrate 104, arm 102, and anchor 116 may comprise various non-conductive or semiconductor materials, such as for example Silicon (Si), single crystal Silicon Carbide (SiC), polysilicon, and Silicon Nitride. Embodiments using Si are expected to be relatively easy to integrate with convention CMOS (Complementary Metal Oxide Semiconductor) process technology, and embodiments using SiC may be suitable for high-temperature operation.

The NEMS switch illustrated in FIG. 1 is a cantilever type switch because arm 102 is coupled to substrate 104 by way of support 116 at one end of arm 102. For a cantilever with length L, width w, and thickness t, its fundamental mode resonant frequency $f_0$ may be expressed as $$f_0 = \frac{\omega_0}{2\pi} = 0.161\frac{t}{L^2}\sqrt{\frac{E_\gamma}{\rho}},$$

where $E_\gamma$ is Young's modulus and ρ is the density of arm 102. An expression for the effective spring constant $k_{eff}$ may be written as $$k_{eff} = M_{eff}\,\omega_0^2 = \frac{3}{4}E_\gamma\left(\frac{t}{L}\right)^3 w,$$

where $M_{eff}$ is an effective mass given by $$M_{eff}=0.645\ \rho Lwt.$$

The pull-in voltage $V_{PI}$ at which arm 102 is pulled down so that contact 106 makes electrical contact with contacts 108 and 110 may be expressed as $$V_{PI} = \sqrt{\frac{8k_{eff}\,g_0^3}{27\varepsilon_0 A}},$$

where $g_0$ is the initial gap from contact 102 to contacts 108 and 110, A is the electrostatic coupling area for actuation electrodes 112 and 114, and $E_0$ is the permittivity. For underdamped operation, the switching time $t_S$ may be expressed as $$t_S = \sqrt{\frac{27}{2}}\,\frac{V_{PI}}{\omega_0 V_{ON}},$$

where $V_{ON}$ is the applied switching voltage, i.e., the voltage difference between actuation electrodes 112 and 114.

From the above equations, it is seen that a small gap size $g_0$ helps in realizing embodiments for a low-voltage, fast NEMS switch, and that there is a trade-off between a smaller $k_{eff}$ (which leads to a lower pull-in voltage $V_{PI}$) and a higher $\omega_0$ (which gives a shorter switching time $t_S$). For example, for some Si embodiments with L=200 nm, w=50 nm, and t=20 nm, and a gap of about 10 nm, the switching speed at 1V actuation voltage was found to be $t_S$=1 ns. Similar performance was found for a SiC embodiment with L=400 nm, w=50 nm, and t=30 nm.

Figure 2:
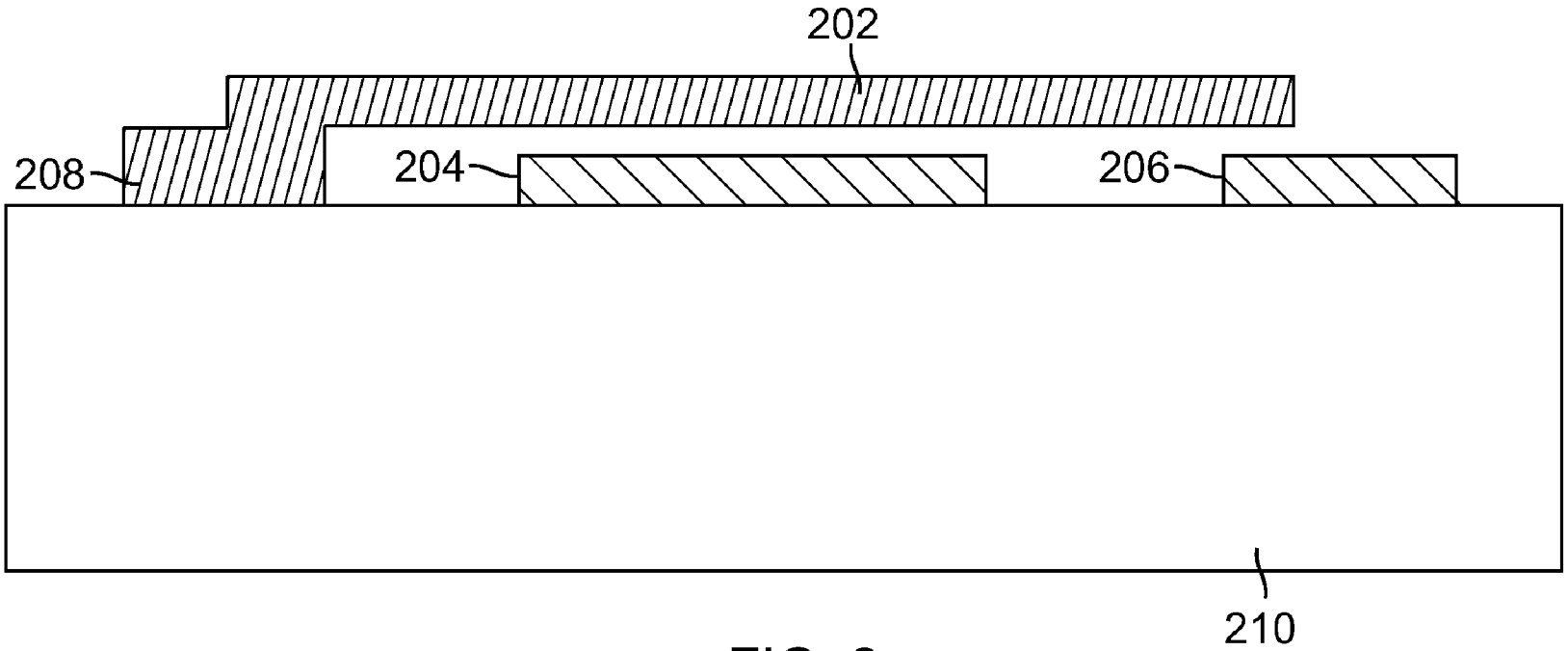

FIG. 2 illustrates a simplified side-view of another embodiment using metallic arm 202. When a voltage difference is applied to actuation electrode 204 and arm 202, the resulting static electric field causes metallic arm 202 to bend towards contact 206. When arm 202 is in contact with contact 206, the switch of FIG. 2 is closed. When the applied static electric field is removed, the inherent restoring force of arm 202 causes arm 202 to break away from contact 206, thereby causing the switch to open. The switch illustrated in FIG. 1 is a cantilever type switch because one of the ends of arm 202, labeled as 208, is coupled (or formed) to substrate 210. Substrate 210, as in other embodiments, may comprise Si, Silicon Nitride, SiC, and polysilicon. These materials serve only as examples. Other embodiments may utilize other materials.

In application when serving as a switch in a circuit, arm 202 may be connected to a ground rail or a supply (power) rail, so that it is held at ground potential or the supply voltage. For example, if arm 202 is held at the supply voltage, then grounding actuation electrode 204 provides a static electric field so that there is an attractive force between arm 202 and actuation electrode 204, thereby closing the switch, whereas holding actuation electrode 204 at the supply voltage removes the static potential difference between arm 202 and actuation electrode 204 so as to open the switch.

Figure 3:
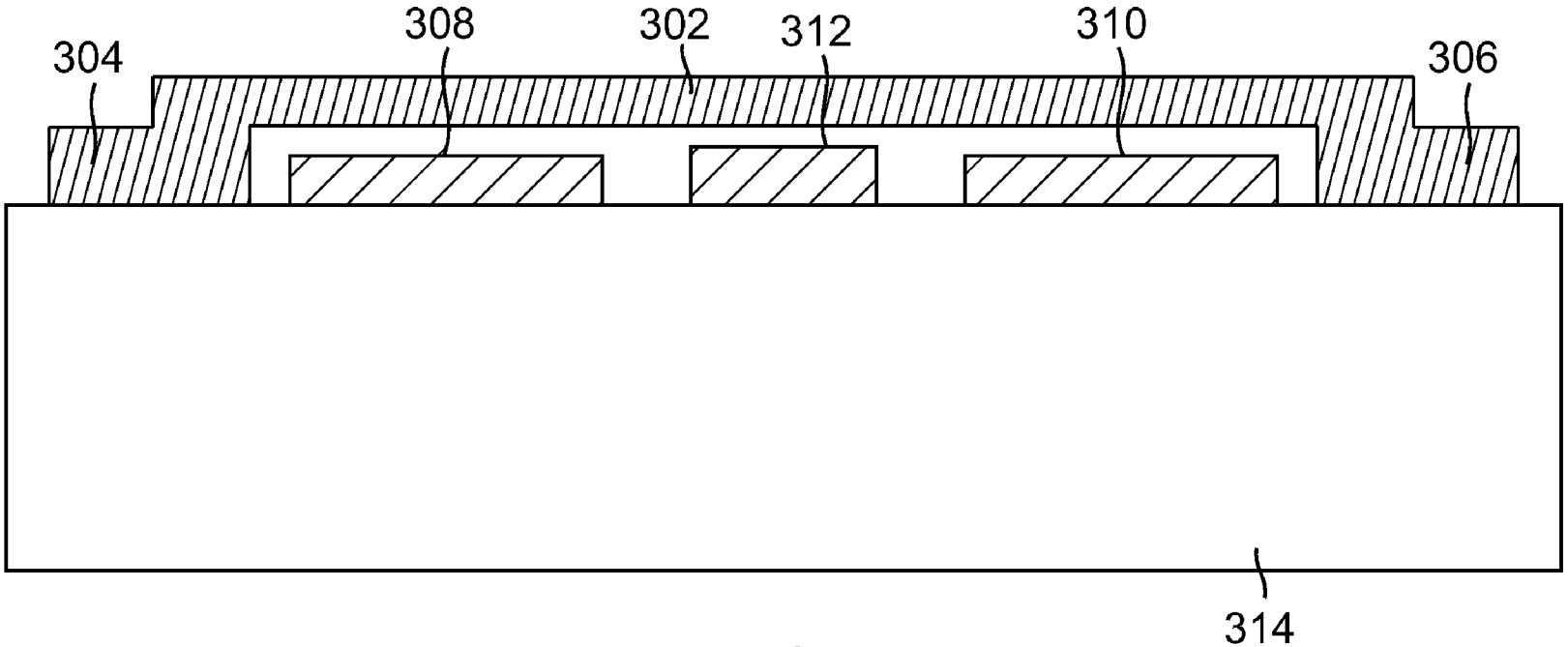

FIG. 3 illustrates a simplified side-view of another embodiment using a metallic, doubly-clamped beam, labeled 302, coupled to substrate 314 at ends 304 and 306. Metallic layers 308 and 310 serve as components of an actuation electrode. That is, metallic layers 308 and 310 are held at the same voltage, and in combination serve as an actuation electrode. Beam 302 may serve as the other actuation electrode. When a voltage difference is applied so that actuation electrodes 308 and 310 are held at a voltage different from that of beam 302, the resulting static electric field causes beam 302 to bend and make contact with contact 312 if the applied voltage difference is sufficiently large. When beam 302 is in contact with contact 312, the switch of FIG. 3 is closed. When the applied static electric field is removed, the inherent restoring force of beam 302 causes beam 302 to break away from contact 312, thereby causing the switch to open. Application of the switch illustrated in FIG. 3 in a circuit is similar to that of FIG. 2, where beam 302 may be connected to a ground rail or a supply rail.

For the particular embodiments illustrated in FIGS. 2 and 3, contact 206 and contact 312 are positioned, respectively, near the free end of arm 202 and the middle of beam 302, which are expected to be at the positions of maximum displacement for arm 202 and beam 302 when a static electric field is applied to close the respective switches.

As examples of the various metallic arms, beams, and contacts, various conductive elements, such as Au (Gold), Al (Aluminum), Cu (Copper), Cr (Chromium), Pt (Platinum), and W (Tungsten), may be used. For an Al cantilever embodiment with L=450 nm, w=150 nm, and t=50 nm, and a gap of about 5 nm, it was found that for 1V actuation voltage the switching speed approached 1 ns.

Figure 4:
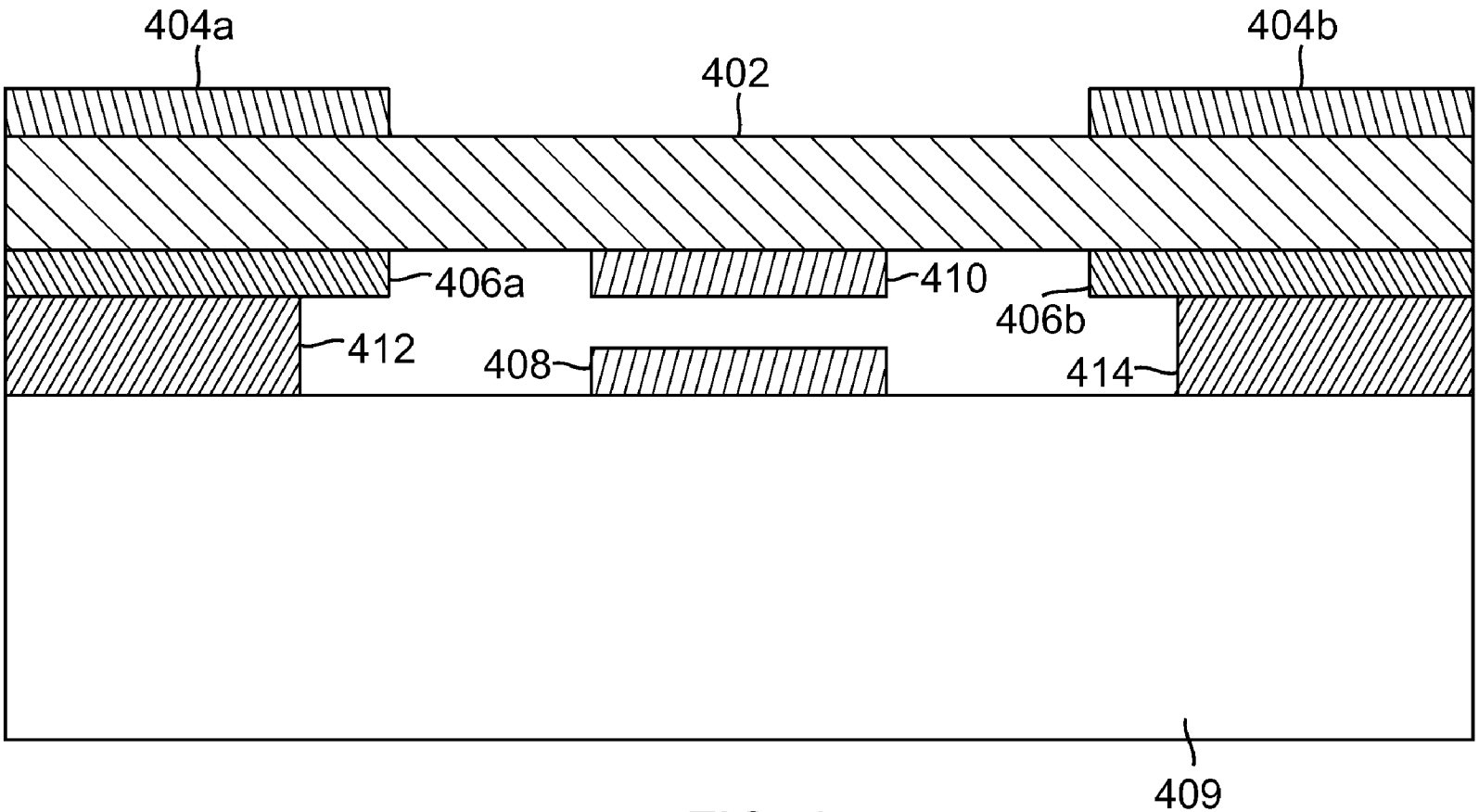
FIGS. 4, 5A, 5B, and 6 illustrate NEMS piezoelectrically actuated switches according to some embodiments.

A simplified side-view of an embodiment using a piezoelectric material is illustrated in FIG. 4. Beam 402 comprises a piezoelectric material, such as for example AlN (Aluminum Nitride). Other piezoelectric materials may be used, such as GaN (Gallium Nitride), ZnO (Zinc Oxide), and for example p-i-n GaAs (Gallium Arsenide), which is described later with respect to FIGS. 5A, 5B, and 6. Formed on the top at the two ends of beam 402 are two components of an actuation electrode, metallic layers 404*a* and 404*b*; and formed on the bottom at the two ends of beam 402 are two components of another actuation electrode, metallic layers 406*a* and 406*a*. ("Top" and "bottom" are in reference to the orientation of FIG. 4.) A vertical static electric field may be generated by holding layers 404*a* and 404*b* at some first voltage and holding layers 406*a* and 406*b* at some second voltage such that beam 402 bends toward contact 408. Contact 408 is formed on substrate 409.

Contact 410 is formed on the (bottom) face of beam 402 facing contact 408. When a vertically oriented static electric field is applied, beam 402 may be caused to bend so that contacts 408 and 410 are in electrical contact. In this case, the switch illustrated in FIG. 4 is closed. The switch may be opened by bringing actuation electrodes 404*a*, 404*b*, 406*a*, and 406*b* to the same voltage potential, or by reversing the direction of the applied static electric field, so that contacts 408 and 410 are no longer touching. Beam 402 is supported on support structures 412 and 414. Support structures 412 and 414 may be formed from an insulator, such as for example Silicon Dioxide ($SiO_2$).

The mechanical stress on a piezoelectric depends upon the applied electric field vector. Accordingly, for an applied electric field vector that causes beam 402 to bend toward contact 408, reversing the direction of the applied electric field vector causes beam 402 to bend away from contact 408. That is, instead of simply relying upon the restoring forces in a bent beam to cause the switch to open when the applied electric field is removed, active breaking of the switch may be effectuated by reversing the applied electric field. That is, for some voltage difference between the actuation electrodes that cause the switch to close, reversing the voltage difference actively opens the switch. It is expected that for some embodiments, this active pull-off of contact 410 away from contact 408 may help overcome stiction and other surface adhesion forces that often plague metal-to-metal DC (direct current) contacts.

In comparing the piezoelectric embodiment of FIG. 4 with the electrostatic coupling embodiments of FIGS. 1 through 3, it is expected that the closing and opening forces in the piezoelectric switch are relatively time independent, and relatively independent of the gap space between beam 402 and substrate 409, when compared to the dependency of the electrostatic coupling force to gap space and time for the electrostatic switches. For the electrostatic switch embodiments if FIGS. 1 through 3, due to the relatively strong variation of coupling capacitance with electrode gap, it is expected that a simple step-function actuation voltage signal may lead to a relatively strong time-varying applied force on the arm (or beam). However, for the piezoelectric switch of FIG. 4, it is expected that a simple step function control voltage applied to the actuation electrodes to close the switch may yield a more step-like function of applied force on the beam. Consequently, it is expected that scaling and design equations for piezoelectric switches may be different than for the electrostatic switches.

For a step-function control voltage applied to the piezoelectric switch of FIG. 4, the optimal switch closure time may likely be at the first extremum of the step-function response of the piezoelectric switch. At this extremum, a piezoelectric switch embodiment may likely reach both its maximum beam displacement and zero beam velocity at nearly the same time. Reaching maximum displacement enables use of the maximum allowable switching gap, whereas a zero beam velocity when contact 410 comes into contact with contact 408 helps switch longevity by mitigating undue morphological degradation of the contact surfaces (e.g., from pitting) upon repeated switch cycling.

For a doubly-clamped beam piezoelectric switch, such as the embodiment of FIG. 4, it is expected that the switching time $t_S$ may be expressed by $$t_S = \frac{1}{4f_0} = 0.242\frac{L^2}{t}\sqrt{\frac{\rho}{E_\gamma}},$$

where the variables take on the same meaning as presented earlier (e.g., L is the length of the beam). For piezoelectric switches employing a cantilever structure, the above numerical factor is 3.106. Taking the maximum displacement as the designed-for gap size $g_0$, the voltage causing the piezoelectric switch to close (the turn-on voltage, $V_{ON}$) may be expressed as $$V_{ON}=(t_{total}{}^4 g_0)/(3L^2 d_{31}\eta),$$

where $t_{total}$ is the total thickness of the composite structure, $d_{31}$ is the (3,1) piezoelectric coefficient in units of Volts/Meter, and $\eta$ is a geometric factor depending on the thickness of each layer in the composite structure comprising the actuation electrodes and piezoelectric material.

As discussed with respect to the electrostatic switches, the above equations suggest that to achieve low voltage and fast switching times for piezoelectric switches, a small gap size $g_0$ may be useful. These equations also suggest a trade-off between higher resonance frequency (leading to shorter switching time) and lower stiffness (yielding a lower turn-on voltage).

For the embodiment of FIG. 4, using $SiO_2$ for the support structures 412 and 414 allows for defining the switching gap accurately by way of utilizing the oxide growth. As a result, it is expected that relatively small gaps may be achievable. For example, a piezoelectric switch with a 60 nm thick AlN piezoelectric layer with a switching time of $t_S$=1 ns and a turn-on voltage of $V_{ON}$=1 volt is realizable with devices having a length of 1 μm and with a gap of about 5 nm.

The embodiment of FIG. 4 may be modified to that of a cantilever design, where components 404B, 406B, and 414 are not present. For such embodiments, contacts 410 and 408 may extend closer to the free end of member 402 (which in this case may be described as an arm instead of a beam).

Figure 5A:
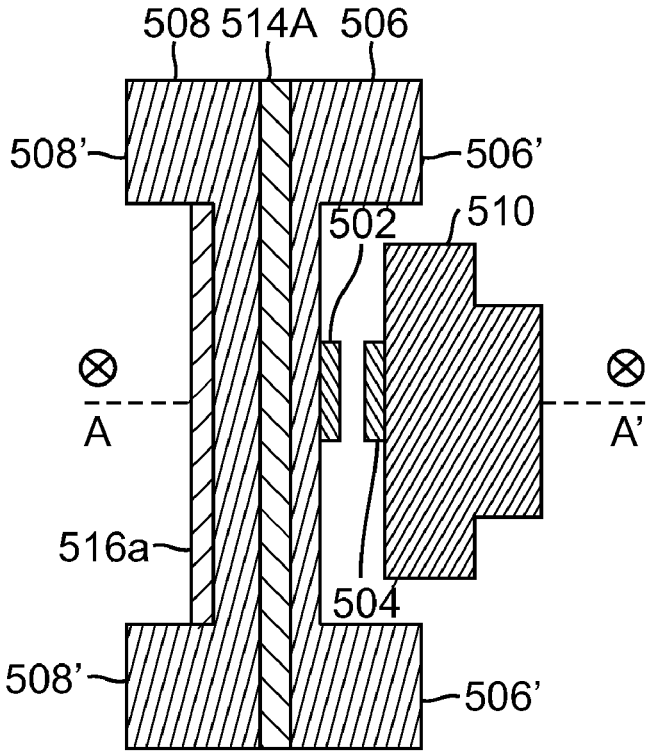
Figure 5B:
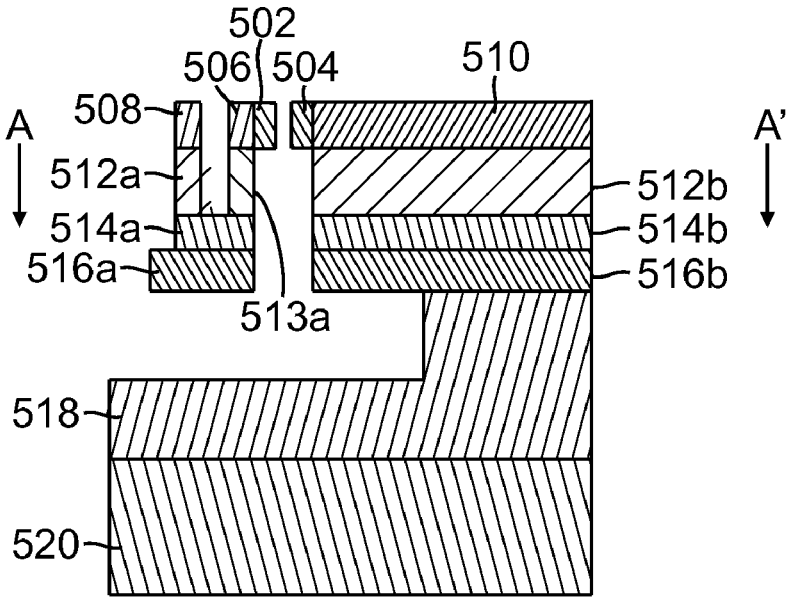

FIGS. 5A and 5B are simplified views of another embodiment based upon a p-i-n GaAs piezoelectric material. FIG. 5A is a simplified plan view. The relationship between the views represented by FIGS. 5A and 5B is denoted by the dashed line A-A'. In FIG. 5A, line A-A' represents a plane perpendicular to the page of the drawing that slices the embodiment, and the crosses above A and A' denote that the view of FIG. 5A is directed into the page of the drawing. The view represented by FIG. 5B is perpendicular to the plane defined by line A-A', so that the crosses in FIG. 5A are now turned into the arrows shown in FIG. 5B. That is, the drawing of FIG. 5A is rotated 90° out of the page, so that FIG. 5B provides a cross-sectional view of the embodiment. The views are simplified in the sense that various components of the structures are not shown for ease of illustration, for otherwise, they would block the view of other components useful in the description of the embodiments.

In FIGS. 5A and 5B, labels 502, 504, 506, 508, and 510 denote metallic structures, where labels 502 and 504 denote metallic contacts. That is, when the switch illustrated in FIGS. 5A and 5B is closed, contacts 502 and 504 come into contact with each other. The switch is open when contacts 502 and 504 are no longer touching each other. Contact 502 is in electrical contact with metallic structure 506, and contact 504 is in electrical contact with metallic structure 510. That is, contact 502 may be patterned out of the same metallic layer as structure 506, and contact 504 may be patterned out of the same metallic layer as structure 510. In application, metallic structure 506 serves as one terminal of the switch, and metallic structure 510 serves as the other terminal. That is, for example, in a circuit application they may be connected to other circuit components, or perhaps a ground rail or supply rail.

For the embodiment of FIGS. 5A and 5B, a sacrificial AlGaAs layer 518 is formed on substrate 520. Next is formed a p++ GaAs layer (516*a* and 516*b*), an intrinsic GaAs layer (514*a* and 514*b*), an n++ GaAs layer (512*a*, 513*a*, and 512*b*), and a metallic layer (502, 504, 506, 508, and 510). By removing selected regions of AlGaAs layer 518 and the metallic layer, the structure illustrated in FIGS. 5A and 5B is fabricated, whereby contacts 502 and 504 are defined, metallic layers 506, 508, and 510 are defined, and a beam structure (comprising 502, 506, 508, 512*a*, 513*a*, 514*a*, and 516*a*) is defined. The p-i-n GaAs layers form a pin diode that provides the piezoelectric effect, where the charge-depleted high-resistance intrinsic region forms the piezoelectrically active layer.

Note that layers 512*a*, 513*a*, 512*b*, 514*b*, 516*b* are hidden in FIG. 5A, and layers 518 and substrate 520 are not shown in FIG. 5A for ease of illustration. Also, portions of metallic structure 506 are not shown in FIG. 5B for ease of illustration, such as for example that portion of metallic structure 506 that would block the view of contacts 502 and 504 in the view of FIG. 5B. Furthermore, referring to FIG. 5A, ends 506' and 508', as well as those portions of layers 512*a*, 513*a*, 514*a*, and 516*a* hidden below 506' and 508', are not shown in the view of FIG. 5B for ease of illustration. Note that the composite beam comprising layers 502, 506, 508, 512*a*, 513*a*, 514*a*, and 516*a* is anchored (coupled) to substrate 520 by way of layer 518.

Metallic structure 508 serves as an actuation electrode, and may be patterned out of the same metallic layer as used for structure 510 and contact 504. A static electric field may be generated by application of a voltage difference to actuation electrode 508 and substrate 520 such that the beam (502, 506, 508, 512*a*, 513*a*, 514*a*, and 516*a*) bends toward the composite structure comprising 504, 510, 512*b*, 514*b*, and 516*b*. If the voltage difference is large enough and has the proper algebraic sign, then this bending may cause contacts 502 and 504 to touch, thereby closing the switch.

Some embodiments may not include metallic structure 508, where the actuation voltage may be directly applied to n++ layer 512*a*.

With proper crystalline alignment, the switch of FIGS. 5A and 5B may have "in-plane" deflection when a static electric field is applied. That is, relative to substrate 520, the motion of contact 502 toward contact 504 is in a lateral direction with respect to substrate 520. Stated in other words, the bottom face of the beam (layer 516*a*) and the portion of layer 518 below this face define a lateral direction whereby the beam moves substantially in a direction parallel to this face and this portion of layer 518. For some embodiments, the entire structure may be patterned by using advanced lithography.

Figure 6:
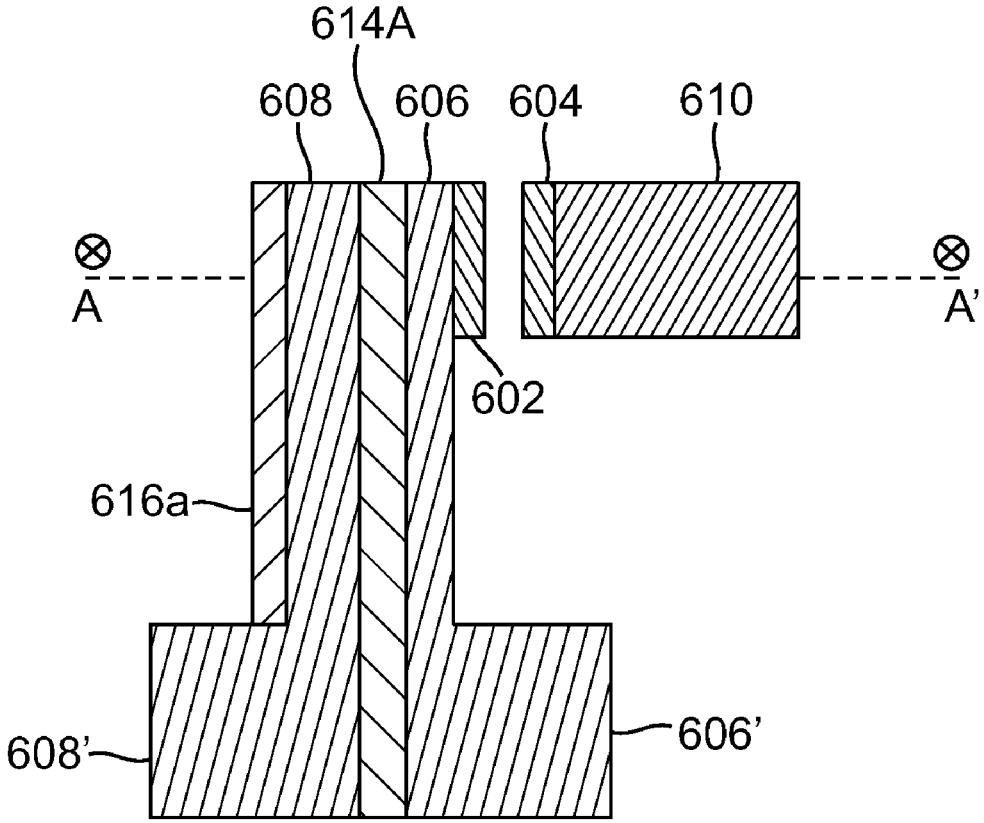

Another piezoelectric switch embodiment, similar to that of FIG. 5A except being of cantilever-type design, is illustrated in FIG. 6. Because of the similarity to that of FIG. 5A, a similar labeling scheme is used, where a component in FIG. 6 is labeled with the same label as its corresponding component in FIG. 5A, except that the first numeral in a label is a "6" instead of a "5". With this labeling scheme in mind, the description of the various components follows that of FIG. 5A, and there is no need to repeat that description. The arm structure comprising 616A, 614A, 608, 612A, 613A, 606, and contact 602 moves laterally toward contact 604, but is coupled to the substrate at only one of its ends by way of layer 518, whereas the beam in the embodiment of FIG. 5A is coupled to the substrate at both of its ends by way of layer 518. A simplified side view of the embodiment in FIG. 6 is essentially the same as FIG. 5B, so that a description and illustration need not be repeated.

For a cantilever embodiment with 200 nm thick p-i-n GaAs (100 nm n++ layer, 50 nm intrinsic layer, and 50 nm p++ layer), with a arm length of about 1 micron and a lateral switching gap of 5 nm, the switching speed for a 10V actuation voltage was found to approach 1 ns.

For a piezoelectric switch, closing and opening the switch depends upon the direction of the electric field relative to the orientation of the piezoelectric material as well as the magnitude of the electric field. For example, for some embodiments according to FIGS. 5A and 5B, the switch closes if the voltage of actuation electrode 508 is greater than the voltage of substrate 520 by an amount equal to the pull-in voltage (assuming the pull-in voltage is chosen as a positive quantity); whereas for some embodiments, the switch closes if the voltage of substrate 520 is greater than the actuation electrode 508 by an amount equal to the pull-in voltage.

Other embodiments may have the order of the n++, intrinsic, and p++ layers reversed, so that the p++ layer is on top and the n++ layer is the layer formed on the sacrificial layer. Other embodiments may also utilize materials other than GaAs.

The contact force of a NEMS switch is the force that the arm or beam applies upon the contact electrode when contact is made. For the electrostatically actuated NEMS cantilever switches with DC contacts, the contact force $F_C$ is roughly in the range of 40% to 90% of the actuation force $F_E$, $$F_C \sim (0.4 \sim 0.9) F_E \sim (0.4 - 0.9) \frac{1}{2} \frac{\varepsilon_0 A V^2}{g_0},$$

where V is the applied control (actuation) voltage and the other symbols have been defined previously in the description of the electrostatically actuated embodiments (e.g., FIGS. 1-3). A conservative design approach is for the forces to satisfy the relationship $$F_C > F_R > F_A,$$

where $F_R$ is the restoring force and $F_A$ is the adhesion force. That is, the above inequality states that the contact force that holds down the switch in its ON state should exceed the mechanical restoring force. This helps to insure that the switch turns ON when the control voltage is applied and held. At the same time, the mechanical restoring force of the NEMS switch should exceed the adhesion force. (The adhesion force may be due to stiction, for example.) This helps to insure that the mechanical restoring force is sufficient to pull the arm back to its OFF state when the control voltage is removed.

As an example, for 20 nm thick Si and 30 nm thick SiC cantilever switches with out-of-plane electrostatic actuation (i.e., the arm or beam bends toward the substrate instead of moving laterally relative to the substrate), the stiffness $k_{eff}$ may be in the range of 0.1 to 10N/m for 100 nm to 500 nm long Si cantilevers; and in the range of 1 to 100N/m for 100 to 500 nm long SiC cantilevers. With switching across gaps of about 5 to 50 nm, the corresponding restoring force for some embodiments was found to be on the order of 0.5 to 500 nN for Si, and 5 nN to 5 μN for SiC.

In the case of piezoelectrically-actuated switches (e.g., FIGS. 5A, 5B, and 6), the possibility of both an active pull-in and an active pull-off may open new design possibilities when compared to electrostatically-actuated switches.

Given the relatively low level of the mechanical restoring force and contact force of NEMS switches, a metal having a relatively low hardness may be of interest for the contacts. For gold contacts, assuming a typical hardness of H=2 GPa, the contact area $A_C$ may be estimated by $$A_C = \pi r^2 = \frac{F_C}{H},$$

where r is the contact radius. Accordingly, a contact force in the range of 1 nN to 10 μN for some embodiments yields a contact radius in the range of 0.4 to 40 nm. It is expected that a good contact may involve working within the weak plastic regime, where plastic deformation may typically be influenced by the hardness of the substrate within a distance of about 3r. Consequently, for some embodiments, it is expected that a typical contact region may have a radius in the range 1.5 nm to 150 nm.

The contact resistance of a NEMS switch when in the ON state, the ON resistance $R_{ON}$, may be estimated by $$R_{ON} \sim \frac{\rho_r}{\pi r} \propto A_C^{-0.5},$$

where $\rho_r$ is the resistivity of the contact metal film and $A_C$ is the contact area. For example, if the contact radius is of the order of 0.4 to 40 nm, then for some embodiments the ON resistance may be estimated under ideal assumptions to be on the order of 0.25 to 25Ω.

By integrating a set, or array, of NEMS switches, they may be connected in parallel to provide a composite NEMS switch with a relatively small effective ON resistance. However, due to process variations, the switches in an array may turn on at different times. Accordingly, a switching network may be utilized to provide varying amounts of programmed delay in the individual control voltages provided to the array of switches so that they switch on nearly simultaneously.

Figure 7:
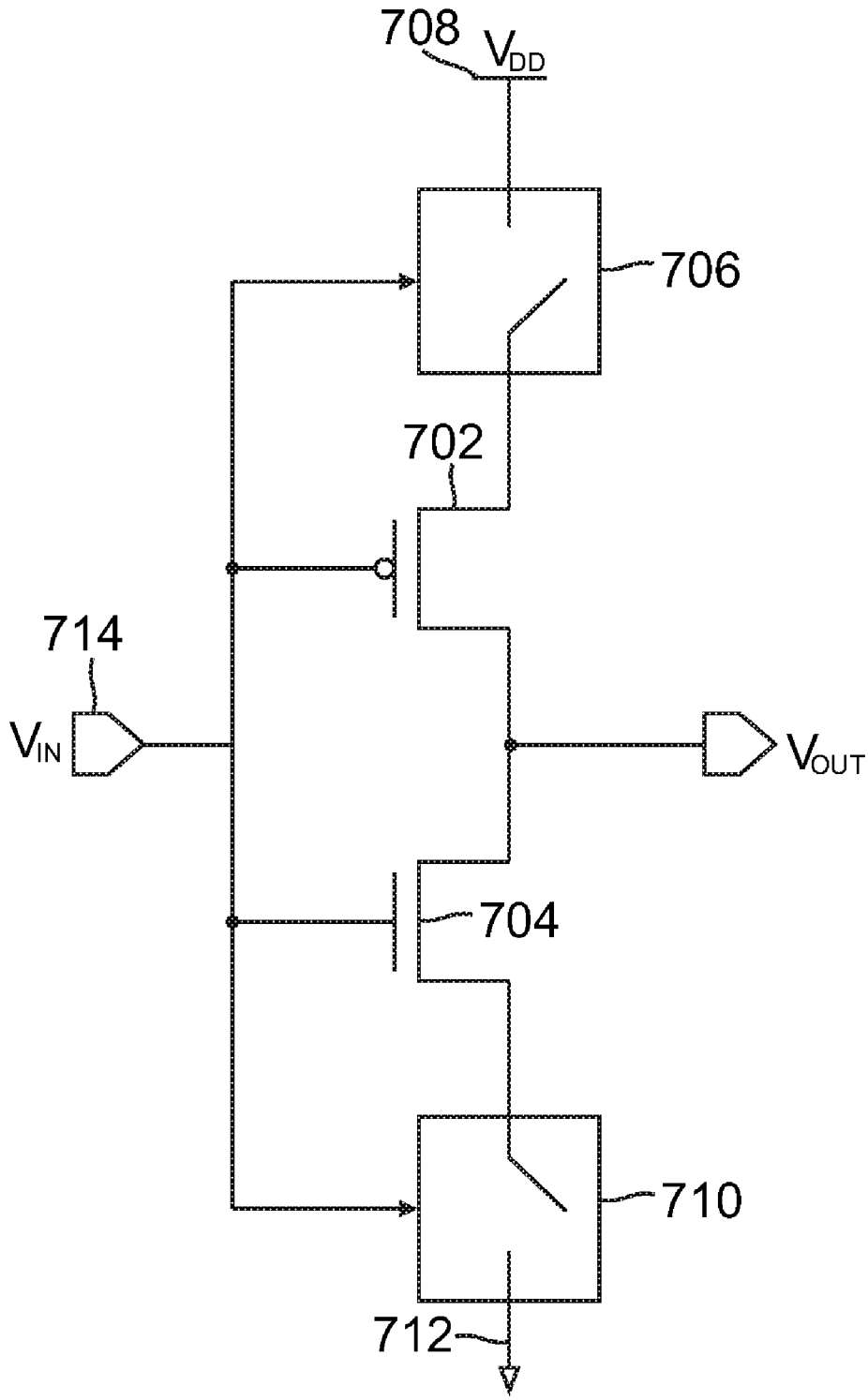
FIG. 7 illustrates NEMS switches with a logic element according to an embodiment.

It is expected that the above-described embodiments may be of utility in numerous applications. As one example, FIG. 7 illustrates the use of NEMS switches in a CMOS inverter. In FIG. 7, the CMOS inverter comprises pMOSFET (p-Metal-Oxide-Semiconductor-Field-Effect-Transistor) 702 and nMOSFET 704. Its operation is well known, and need not be described. With feature sizes decreasing, leakage current may be a problem for some designs. That is, a transistor may not completely turn off, so that even when in a so-called OFF state, there still may be an unacceptable about of leakage current through the transistor. In the embodiment of FIG. 7, NEMS switch 706 is connected between the source terminal of pMOSFET 702 and supply rail 708, and NEMS switch 710 is connected between the source terminal of nMOSFET 704 and ground rail 712. The input voltage at input port 714 also provides an actuation voltage for switches 706 and 710.

Switches 706 and 710 are configured so that when the input voltage is HIGH, switch 706 is OFF and switch 710 is ON; and when the input voltage is LOW, switch 706 is ON and switch 710 is OFF. An important design goal is that a NEMS switch in its ON state should have a contact resistance small enough to be comparable to that of the transistors themselves.

In a logic circuit such as the inverter of FIG. 7, one of the MOS transistors is always in the OFF state, so that the voltage drop across a NEMS switch is either the ON ($V_{DD}$) voltage or the OFF (ground) voltage. With a proper time delay introduced between the switching of a transistor and its associated NEMS switch, the latter need not see the full on-state voltage. This may help to insure device longevity.

Various modifications may be made to the described embodiments without departing from the scope of the invention as claimed below.

It is to be understood in these letters patent that the meaning of "A is connected to B", where A or B may be, for example, a node or device terminal, is that A and B are connected to each other so that the voltage potentials of A and B are substantially equal to each other. For example, A and B may be connected together by an interconnect (transmission line). In integrated circuit technology, the interconnect may be exceedingly short, comparable to the device dimension itself. For example, the gates of two transistors may be connected together by polysilicon, or copper interconnect, where the length of the polysilicon, or copper interconnect, is comparable to the gate lengths. As another example, A and B may be connected to each other by a switch, such as a transmission gate, so that their respective voltage potentials are substantially equal to each other when the switch is ON.

It is also to be understood in these letters patent that the meaning of "A is coupled to B" is that either A and B are connected to each other as described above, or that, although A and B may not be connected to each other as described above, there is nevertheless a device or circuit that is connected to both A and B. This device or circuit may include active or passive circuit elements, where the passive circuit elements may be distributed or lumped-parameter in nature. For example, A may be connected to a circuit element that in turn is connected to B.

What is claimed is:

1. An apparatus, comprising:

a substrate;

a first conductive layer formed on the substrate;

a first actuation electrode formed on the substrate or on a member coupled to the substrate, wherein the first actuation electrode on the substrate is separated from the first conductive layer;

the member coupled to the substrate and having a first side facing the substrate, and a second side;

the member comprising one or more conductive members; and wherein:

(1) the apparatus comprises a nano-electromechanical system (NEMS) switch for switching DC (direct current) in a logic circuit;

(2) when the first conductive layer and one of the conductive members are electrically connected with the DC, the NEMS switch is in an ON or closed state;

(3) when there is a gap between the first conductive layer and the one of the conductive members, the NEMS switch is in an OFF or open state; and (4) a voltage difference between the first actuation electrode and one of the conductive members switches the NEMS switch between the OFF or open state and the ON or closed state.

2. The apparatus as set forth in claim 1, further comprising:

a second conductive layer formed on the substrate;

the conductive members comprising a third conductive layer formed on the first side and a second actuation electrode;

the apparatus having a pull-in voltage so that the third conductive layer is in contact with the first and second conductive layers if the voltage difference is greater in magnitude than the pull-in voltage, and wherein:

the member comprises a cantilever arm, the voltage difference is between the first actuation electrode and the second actuation electrode to switch the NEMS switch between the OFF or open state and the ON or closed state, and the NEMS switch is in the ON or closed state when the first conductive layer, the second conductive layer, and the third conductive layer are electrically connected with the DC.

3. The apparatus as set forth in claim 2, the arm comprising a material selected from the group consisting of silicon, silicon carbide, silicon nitride, and polysilicon.

4. The apparatus of claim 2, wherein:

the voltage difference is sufficient only to electrically connect the first conductive layer, the second conductive layer, and the third conductive layer in the ON or closed state, and the cantilever arm is not curled away from the substrate in the OFF or open state.

5. The apparatus as set forth in claim 2, further comprising:

a rail connected to the first conductive layer; and a logic element connected to the second conductive layer.

6. The apparatus as set forth in claim 5, wherein:

the logic element comprises an inverter having an input port connected to the first actuation electrode; and the second actuation electrode is connected to the rail.

7. The apparatus as set forth in claim 5, wherein:

the logic element comprises an inverter having an input port connected to the second actuation electrode; and the first actuation electrode is connected to the rail.

8. The apparatus as set forth in claim 1, wherein:

the member comprises a single conductive member having a first end and a second end, and the conductive member is coupled to the substrate at the first end; and the apparatus having a pull-in voltage so that the conductive member is in contact with the first conductive layer if the voltage difference is greater in magnitude than the pull-in voltage.

9. The apparatus as set forth in claim 8, wherein the conductive member forms a cantilever about the first end and comes into contact with the first conductive layer at the second end if the voltage difference is greater in magnitude than the pull-in voltage.

10. The apparatus as set forth in claim 8, the conductive member coupled to the substrate at the second end, the apparatus further comprising:

a second actuation electrode formed on the substrate and at a same voltage potential as the first actuation electrode.

11. The apparatus as set forth in claim 10, the conductive member having a middle, wherein the conductive member comes into contact with the first conductive layer at the middle if the voltage difference is greater in magnitude than the pull-in voltage.

12. The apparatus as set forth in claim 8, further comprising:

a rail connected to conductive member;

a logic element connected to the first conductive layer.

13. The apparatus as set forth in claim 12, wherein:

the logic element comprises an inverter having an input port connected to the first actuation electrode.

14. The apparatus as set forth in claim 8, further comprising:

a rail connected to first conductive layer;

a logic element connected to the conductive member.

15. The apparatus as set forth in claim 14, wherein:

the logic element comprises an inverter having an input port connected to the first actuation electrode.

16. The apparatus as set forth in claim 1, wherein:

the member comprises a piezoelectric member having the first side facing the substrate, the second side, a first end coupled to the substrate, and a second end; and the conductive members comprise:

a second conductive layer formed on the first side;

the first actuation electrode formed on the first side; and a second actuation electrode formed on the second side.

17. The apparatus as set forth in claim 16, the apparatus having a pull-in voltage, the first and second actuation electrodes having a first and second voltage, respectively, so that the second conductive layer comes into contact with the first conductive layer if the first voltage is greater than the second voltage by an amount equal to the pull-in voltage.

18. The apparatus as set forth in claim 16, the apparatus having a pull-in voltage, the first and second actuation electrodes having a first and second voltage, respectively, so that the second conductive layer comes into contact with the first conductive layer if the second voltage is greater than the first voltage by an amount equal to the pull-in voltage.

19. The apparatus as set forth in claim 16, the piezoelectric member comprising Aluminum Nitride.

20. The apparatus as set forth in claim 16, the piezoelectric member coupled to the substrate at the second end, the first actuation electrode comprising a first conductive member formed at the first end and a second conductive member formed at the second end; and the second actuation electrode comprising a first conductive member formed at the first end and a second conductive member formed at the second end.

21. The apparatus as set forth in claim 1, further comprising:

a sacrificial layer formed on the substrate;

the member comprising a piezoelectric material and having an end coupled to the substrate by way of the sacrificial layer, having the first side facing the sacrificial layer, and having the second side facing away from the sacrificial layer, the first side and the sacrificial layer defining a lateral direction;

the conductive members comprising:

the first actuation electrode formed on the second side; and a second conductive layer formed on the second side and comprising a contact;

wherein the member moves in the lateral direction in the presence of an applied static electric field provided by a voltage difference between the first actuation electrode and the substrate.

22. The apparatus as set forth in claim 21, the member having a second end coupled to the substrate by way of the sacrificial layer.

23. The apparatus as set forth in claim 21, the piezoelectric material comprising n-i-p GaAs.

24. The apparatus as set forth in claim 23, the sacrificial layer comprising AlGaAs.

25. The apparatus as set forth in claim 21, the first actuation electrode comprising a doped semiconductor.

26. The apparatus as set forth in claim 21, the first actuation electrode comprising a metallic layer.

27. The apparatus of claim 1, wherein:

the first actuation electrode has one or more first dimensions;

the member comprises one or more materials and one or more second dimensions; and the first dimensions, the second dimensions, the materials, and the gap are such that the voltage difference of at most 1 Volt switches the NEMS switch between the OFF or open state and ON or closed state in a switching time of at most 1 nanosecond.

28. The apparatus of claim 1, wherein:

the member comprises a length of 200 nanometers—1 micrometer and a thickness of 20 nanometers—50 nanometers, the gap is 5 nanometers—50 nanometers, and the first conductive layer has an area corresponding to a radius of 1.5~150 nanometers.

29. The apparatus of claim 1, further comprising a pair of the NEMS switches forming the logic circuit that is an inverter or that performs logic operations.

30. The apparatus of claim 1, wherein:

the NEMS switch comprises only three terminals, the terminals comprising the first conductive layer, the first actuation electrode, and the one conductive member, and the first conductive layer comprises a drain contact, the first actuation electrode comprises a gate, and the one conductive member comprises a source contact.

31. The apparatus of claim 30, wherein:

the member is a metallic arm, the metallic arm is held at a single potential or no electrical signal is applied to the metallic arm, and the gate is not movable.

* * * * *